US009057373B2

(12) United States Patent
Picouet

(10) Patent No.: US 9,057,373 B2
(45) Date of Patent: Jun. 16, 2015

(54) SINGLE SCREW COMPRESSOR WITH HIGH OUTPUT

(71) Applicant: Vilter Manufacturing LLC, Cudahy, WI (US)

(72) Inventor: Jean-Louis Picouet, Waukesha, WI (US)

(73) Assignee: Vilter Manufacturing LLC, Cudahy, WI (US)

( * ) Notice: Subject to any disclaimer, the term of this patent is extended or adjusted under 35 U.S.C. 154(b) by 224 days.

(21) Appl. No.: 13/673,533

(22) Filed: Nov. 9, 2012

(65) Prior Publication Data

US 2013/0129553 A1 May 23, 2013

Related U.S. Application Data

(60) Provisional application No. 61/562,721, filed on Nov. 22, 2011.

(51) Int. Cl.

| | |
|---|---|
| ***F04C 3/02*** | (2006.01) |
| ***F04C 3/04*** | (2006.01) |
| ***F04C 18/08*** | (2006.01) |
| ***F04C 18/52*** | (2006.01) |

(52) U.S. Cl.

CPC . *F04C 18/08* (2013.01); *F04C 3/02* (2013.01); *F04C 18/52* (2013.01); *F04C 18/084* (2013.01)

(58) Field of Classification Search

CPC ..... F04C 18/08; F04C 18/084; F04C 18/52; F04C 18/50; F04C 3/02

USPC ..... 418/195, 190, 201.1, 201.3, 206.9

See application file for complete search history.

(56) References Cited

U.S. PATENT DOCUMENTS

| | | | |
|---|---|---|---|
| 2,920,814 | A | 1/1960 | Breelle |
| 3,182,900 | A | 5/1965 | Thorson |

(Continued)

FOREIGN PATENT DOCUMENTS

| | | |
|---|---|---|
| EP | 2228537 A1 | 9/2010 |
| GB | 1102021 | 2/1968 |

(Continued)

OTHER PUBLICATIONS

High Efficiency Multiple Screw Pump, Brennan, James, Colfax Corporation, Pump & System, Apr. 2007.*

(Continued)

*Primary Examiner* — Kenneth Bomberg
*Assistant Examiner* — Deming Wan
(74) *Attorney, Agent, or Firm* — Whyte Hirschboeck Dudek S.C.

(57) ABSTRACT

In one aspect, a single screw compressor is disclosed. The compressor, in at least some embodiments, includes: a housing including a cylindrical bore; a pair of gate rotors mounted for rotation in the housing, each gate rotor having a plurality of gear teeth; and a main rotor rotatably mounted in the bore and having a plurality of grooves, a plurality of lands, an additional groove, and an additional land; wherein the plurality of lands of the main rotor comprises a first wrap angle and the additional land comprises a second wrap angle, and the second wrap angle is distinct and different from the first wrap angle. In other aspects, a method of assembling a gate rotor in relation to a main rotor that is positioned within a single screw gas compressor configured for high output, and a main rotor device for use with a single screw compressor configured for high output are also disclosed.

14 Claims, 7 Drawing Sheets

(56) References Cited

U.S. PATENT DOCUMENTS

| | | | | |
|---|---|---|---|---|
| 3,289,600 | A | 12/1966 | Whitfield | |
| 3,414,189 | A | 12/1968 | Persson | |
| 3,437,263 | A | 4/1969 | Persson | |
| 3,640,649 | A | 2/1972 | Persson | |
| 3,787,154 | A | 1/1974 | Edstrom | |
| 3,874,828 | A | 4/1975 | Herschler et al. | |
| 3,877,846 | A | 4/1975 | Lundberg | |
| 4,007,715 | A | 2/1977 | Bonnell et al. | |
| 4,074,957 | A | 2/1978 | Clarke et al. | |
| 4,261,691 | A | 4/1981 | Zimmern et al. | |
| 4,350,480 | A | 9/1982 | Bammert | |
| 4,508,496 | A | 4/1985 | Bowman | |
| 4,610,612 | A | 9/1986 | Kocher | |
| 4,614,484 | A | 9/1986 | Riegler | |
| 4,890,989 | A | 1/1990 | Zimmern | |
| 4,900,239 | A | 2/1990 | Zimmern | |
| 4,981,424 | A | 1/1991 | Bein | |
| 5,080,568 | A | 1/1992 | Zimmern | |
| 5,129,800 | A | 7/1992 | Boblitt | |
| 5,317,882 | A | 6/1994 | Ritenour | |
| 5,642,992 | A | 7/1997 | Shaw | |
| 5,782,624 | A | 7/1998 | Jensen | |
| 6,106,241 | A | 8/2000 | Zimmern | |
| 6,186,758 | B1 | 2/2001 | Shaw | |
| 6,398,532 | B1 | 6/2002 | Zha et al. | |
| 8,876,431 | B1 | 11/2014 | Becker et al. | |
| 2004/0037730 | A1* | 2/2004 | Ueno et al. | 418/195 |
| 2004/0067149 | A1* | 4/2004 | Giebmanns et al. | 418/151 |
| 2010/0003153 | A1 | 1/2010 | Ohtsuka et al. | |
| 2010/0074785 | A1 | 3/2010 | Ohtsuka et al. | |
| 2010/0158737 | A1 | 6/2010 | Gotou et al. | |
| 2010/0183468 | A1 | 7/2010 | Hossain et al. | |
| 2010/0247364 | A1 | 9/2010 | Hossain et al. | |
| 2010/0260637 | A1 | 10/2010 | Murono et al. | |
| 2010/0260639 | A1 | 10/2010 | Hossain et al. | |
| 2010/0278677 | A1 | 11/2010 | Hossain et al. | |
| 2010/0278678 | A1 | 11/2010 | Gotou et al. | |
| 2010/0284848 | A1 | 11/2010 | Fujiwara et al. | |
| 2010/0329918 | A1 | 12/2010 | Gotou et al. | |
| 2011/0070117 | A1* | 3/2011 | Miyamura et al. | 418/201.3 |
| 2011/0097232 | A1 | 4/2011 | Miyamura et al. | |
| 2011/0165009 | A1 | 7/2011 | Hossain et al. | |

FOREIGN PATENT DOCUMENTS

| | | | |
|---|---|---|---|
| GB | 1102021 | A | 2/1968 |
| GB | 2438034 | A | 11/2007 |
| JP | 2001263275 | | 9/2001 |
| JP | 2001263275 | A | 9/2001 |
| JP | 2008215245 | A | 9/2008 |
| JP | 2010024984 | | 2/2010 |
| JP | 2010024984 | A | 2/2010 |
| JP | 2010144685 | | 7/2010 |
| JP | 2010144685 | A | 7/2010 |
| JP | 2010196582 | | 9/2010 |
| JP | 2010196582 | A | 9/2010 |
| JP | 2010249045 | | 11/2010 |
| JP | 2010249045 | A | 11/2010 |
| JP | 2011021574 | | 2/2011 |
| JP | 2011021574 | A | 2/2011 |
| JP | 2011038484 | | 2/2011 |
| JP | 2011038484 | A | 2/2011 |
| RU | 2278980 | C1 | 6/2006 |
| RU | 02377414 | | 12/2009 |
| WO | 02073037 | A1 | 9/2002 |
| WO | 2010109839 | | 9/2010 |
| WO | 2010109839 | A1 | 9/2010 |

OTHER PUBLICATIONS

European Patent Application No. 12193263.6; Extended European Search Report; Aug. 22, 2013; 5 pages.

European Office Action for Application No. 12193263.6 dated Dec. 16, 2014, 4 pages.

* cited by examiner

SINGLE SCREW COMPRESSOR WITH HIGH OUTPUT

CROSS REFERENCE TO RELATED APPLICATION

This application claims the benefit of U.S. Provisional Application No. 61/562,721, filed Nov. 22, 2011, the disclosure of which is incorporated by reference in its entirety herein.

FIELD OF THE INVENTION

The present invention relates to single screw compressors and, more particularly, to single screw compressors having high output and increased capacity.

BACKGROUND

Compressors are used in various compression systems, such as refrigeration systems, to compress gas, such as Freon, ammonia, natural gas, or the like. One type of compressor is a single screw gas compressor, which is generally comprised of three basic components that rotate and complete the work of the compression process. These components include a single cylindrical main screw rotor with helical grooves separated by a plurality of identical lands, and two gate rotors (also known as star or star-shaped rotors), with each gate rotor having a plurality of teeth that extend radially outwardly from its center. The rotational axes of the gate rotors are parallel to each other and mutually perpendicular to the axis of the main screw rotor. This type of compressor employs a housing in which the helical grooves of the main rotor mesh with the teeth of the gate rotors on opposite sides of the main rotor to define gas compression chambers. The housing is provided with two gas suction ports, typically one near each gate rotor, for inputting the gas and with two gas discharge channels, again typically one near each gate rotor, for entry and exit of the gas to the gas compression chambers. It is known to provide two dual slide valve assemblies on the housing, with one assembly typically positioned near each gate rotor, with each slide valve assembly comprising a suction valve (also referred to as a "capacity slide valve") and a discharge slide valve (also referred to as a "volume slide valve") for controlling an associated intake channel and an associated discharge channel, respectively. In operation, an electric motor imparts rotary motion through a driveshaft to the compressor's main rotor, which in turn rotates the two intermeshed gate rotors, and gas is compressed in the gas compression chambers.

Known main rotors comprise identical lands consisting of a single wrap angle. More particularly, the single wrap angle corresponds to, or otherwise describes, a starting point on the outer diameter of a respective one of the lands of the main rotor as the point travels, during rotation of the rotor about its rotational axis, from the starting point on the respective land of the rotor to a final point on the respective land of the rotor.

It has been determined that an increase in the wrap angle of the main rotor (i.e., particularly the single wrap angle of the respective identical lands of the main rotor) results in an increase in compressor output. In general, for a given main rotor diameter, for example, an outside diameter corresponding to outside surfaces of the lands, and a given gaterotor diameter, the wrap angle of any given main rotor must remain below 180 degrees so as to permit mounting of the gaterotor with respect to the main rotor when the main rotor is already positioned in the housing of the compressor, as is typically the case during assembly of the compressor.

It would be advantageous to provide a single screw compressor with high output that overcomes the problems associated with the above.

BRIEF DESCRIPTION OF THE DRAWINGS

Features of the present disclosure which are believed to be novel are set forth with particularity in the appended claims. Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings:

SUMMARY

In one aspect, a single screw compressor is disclosed. The compressor, in at least some embodiments, includes: a housing including a cylindrical bore; a pair of gate rotors mounted for rotation in the housing, each gate rotor having a plurality of gear teeth; and a main rotor rotatably mounted in the bore and having a plurality of grooves, a plurality of lands, an additional groove, and an additional land; wherein the plurality of lands of the main rotor comprises a first wrap angle and the additional land comprises a second wrap angle, and the second wrap angle is distinct and different from the first wrap angle.

In another aspect, a method of assembling a gate rotor in relation to a main rotor that is positioned within a housing of a single screw gas compressor configured for high output, the gate rotor having a plurality of gear teeth, the main rotor having a plurality of grooves, a plurality of lands, an additional groove, and an additional land is disclosed. In at least some embodiments, the method comprises positioning the gaterotor such that at least one of the plurality of gear teeth is configured to be received within the additional groove, the additional groove being positioned adjacent the additional land; and wherein the plurality of lands of the main rotor comprises a first wrap angle and the additional land comprises a second wrap angle, and the second wrap angle is distinct and different from the first wrap angle.

In another aspect a main rotor device for use with a single screw compressor configured for high output is disclosed. In at least some embodiments, the main rotor comprises a main rotor body having formed therein a plurality of grooves, a plurality of lands, an additional groove, and an additional land; and wherein the plurality of lands of the main rotor comprises a first wrap angle and the additional land comprises a second wrap angle, and the second wrap angle is distinct and different from the first wrap angle.

Other aspects, features, objects, and embodiments will be apparent in view of the present disclosure.

DETAILED DESCRIPTION

Figure 1:
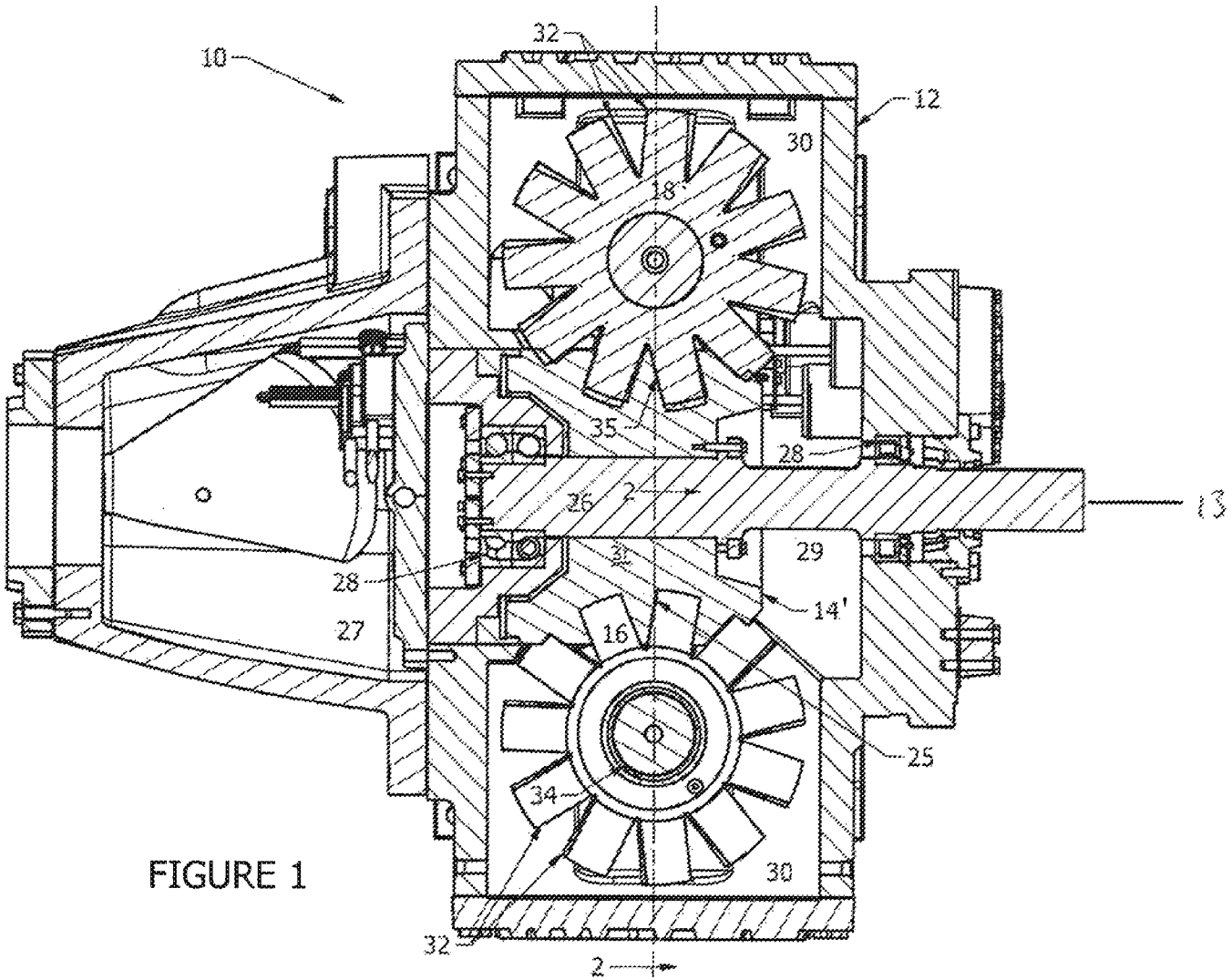
FIG. 1 is a top view, partly in cross-section and with portions broken away, of an exemplary compressor, the compressor employing a single screw rotor and a pair of gate rotors in accordance with at least some embodiments of the present disclosure.
Figure 2:
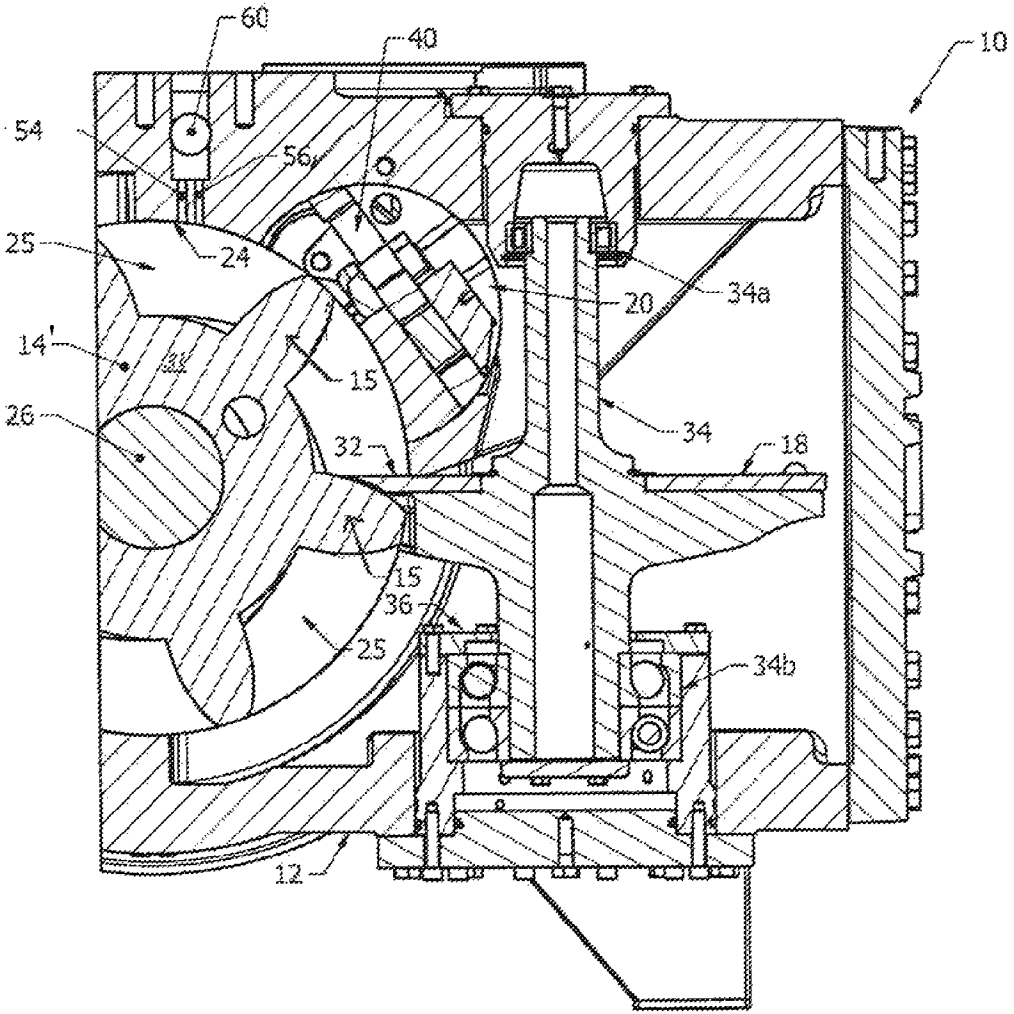
FIG. 2 is an enlarged cross-sectional view taken along line 2-2 of FIG. 1.
Figure 3:
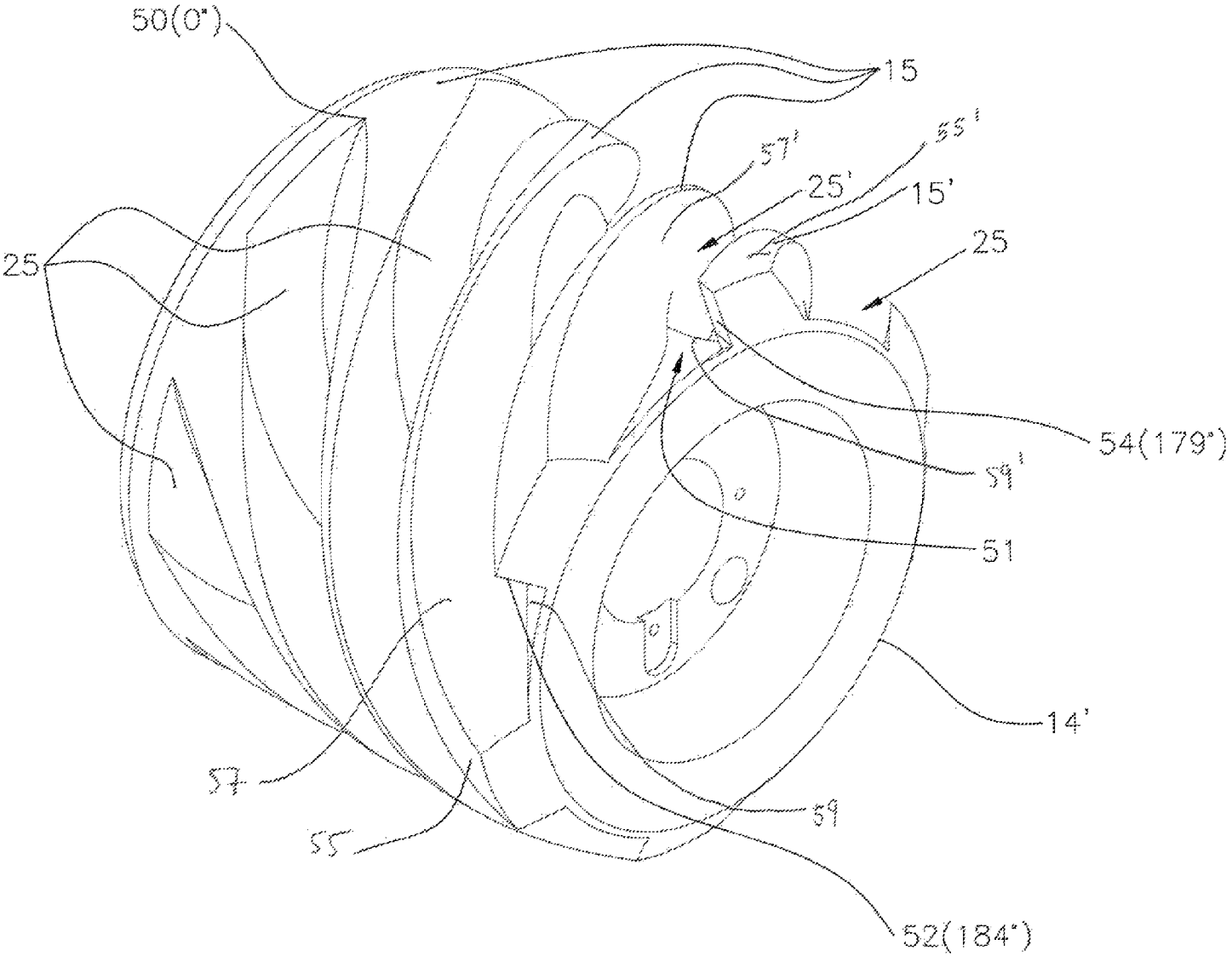
FIG. 3 is a perspective view of a main rotor in accordance with embodiments of the present disclosure.

Referring to FIGS. 1, 2 and 3, reference number 10 designates an exemplary single screw rotary gas compressor that can be used to compress a gas with a high output and may also be referred to as a "single screw compressor with high output", "compressor", or "high output compressor" in accordance with embodiments of the present disclosure. Compressor 10 generally comprises a compressor housing 12, a main rotor device 14', which may also be referred to as a "main rotor" in accordance with embodiments of the present disclosure, mounted for rotation, about an axis 13, in housing 12, as well as a pair of gate rotors 16 and 18 mounted for rotation in housing 12 and engaged with main rotor 14'. Compressor 10 further includes two sets of exemplary slide valve assemblies 20 (only one of which is shown in FIG. 2) mounted in housing 12 and cooperable with main rotor 14' to control gas flow into and from the gas compression chambers 35 on the main rotor 14'.

Compressor housing 12 includes a cylindrical bore 24 in which main rotor 14' is rotatably mounted. Bore 24 is open at its discharge end 27 and is closed by an intake end wall 29. Main rotor 14', which is a generally cylindrical main rotor body 31, has a plurality of helical grooves 25 formed therein (e.g., six grooves) defining gas compression chambers 35, is provided with a rotor output shaft 26 which is rotatably supported at opposite ends on bearing assemblies 28 mounted on housing 12. The grooves 25, 25' of main rotor 14' are separated from each other via respective lands 15, 15' (land 15' and groove 25' described further below). In accordance with embodiments of the present disclosure, each of the plurality of lands 15, 15' corresponds to or comprises a respective wall that is located between a respective pair of adjacent grooves.

Compressor housing 12 includes spaces 30 therein in which the gate rotors 16 and 18 are rotatably mounted and the gate rotors 16 and 18 are located on opposite sides (i.e., 180 degrees apart) of main rotor 14'. Each of the gate rotors 16 and 18 has a plurality of gear teeth 32 (for example, eleven are illustrated) and is provided with a respective gate rotor shaft 34 which is rotatably supported at opposite ends on bearing assemblies 34A and 34B (FIG. 2) mounted on housing 12. Each of the gate rotors 16 and 18 rotate on a respective axis which is perpendicular to and spaced from the axis of rotation of main rotor 14' and have respective teeth 32 that extend through an opening 36 communicating with bore 24. Each of the respective teeth 32 extends radially (e.g., radially outwardly) from the respective rotor shaft (e.g., rotor shaft 34) of the respective gate rotor (e.g., gate rotor 18). Each one of the teeth 32 of each of the gate rotors 16 and 18 successively is engaged with a respective one of the grooves 25, 25' in main rotor 14' and, in cooperation with the wall of bore 24, specifically including, for example, its end wall 29, these each define a gas compression chamber 35 (one of which is identified in FIG. 1). The aforementioned engagement allows the rotor output shaft to be driven, for example by a motor (not shown), to drive main rotor 14' and, in turn, gate rotors 16 and 18.

The compressor housing 12 is provided with gas suction ports 40 (one near each gate rotor) and with a gas discharge port (not shown). Each slide valve assembly 20 comprises a suction slide valve and a discharge slide valve for controlling the associated suction port and the associated discharge port, respectively. The slide valves can additionally be employed for accomplishing loading and unloading of the compressor by controlling admission and discharge of gas into and from the gas compression chambers, in a known manner.

In operation, gas is drawn in through the gas suction port and is routed through the compression chambers 35 for compression therein. Typically, compression of the gas is achieved by rotation of the gate rotors 16, 18 which are synchronized with the main rotor 14', which is driven, as by a drive motor (not shown), causing the gear teeth 32 of the gate rotors to intermesh with the helical grooves 25, 25' of the main rotor. By virtue of such intermeshing engagement between the gear teeth 32 of the gate rotors 16, 18 and the helical grooves of the main rotor 14', the volume of the gas is reduced, thereby achieving compression of the gas. The compressed gas from each associated compression chamber 35 then exits through its associated discharge port. In general, the operation of compressors for compressing gas (e.g., single rotary screw compressors) is well known in the art.

Figure 4:
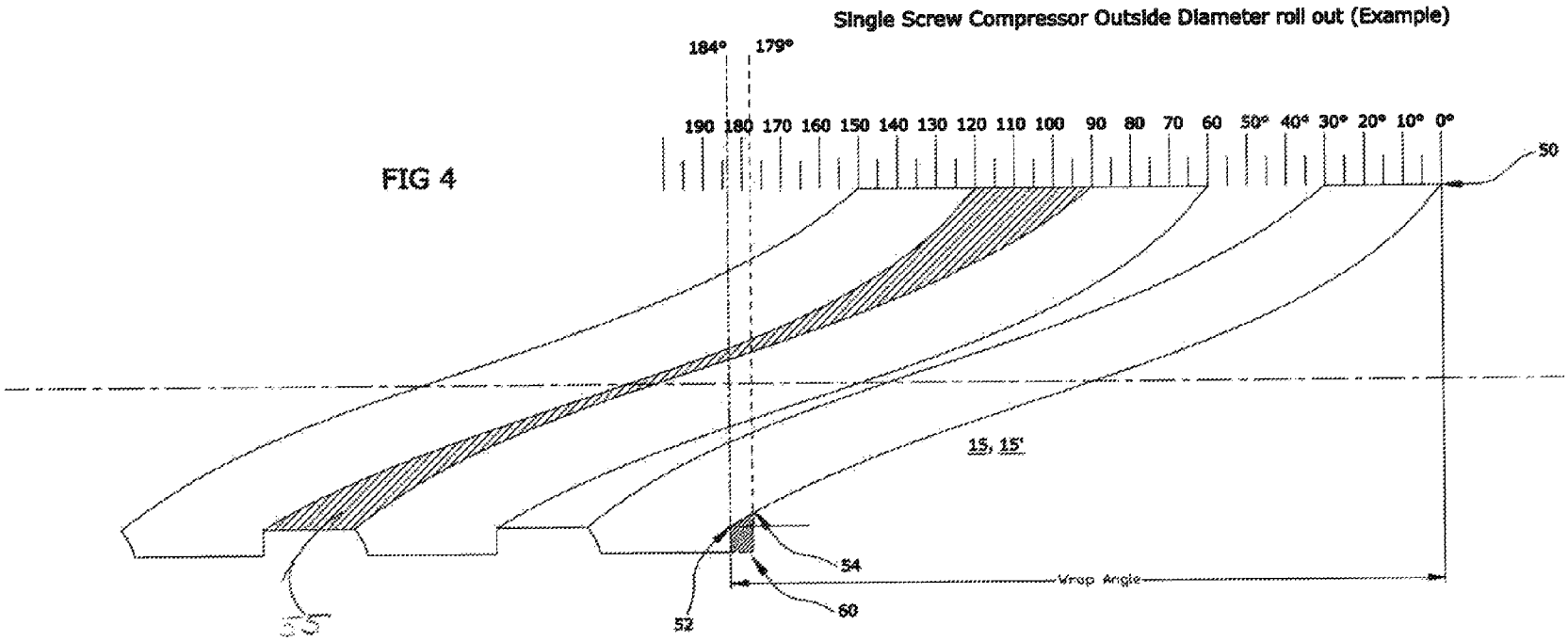
FIG. 4 is a view of a two-dimensional roll-out representation of the outside surface of the main rotor of FIG. 3.

FIG. 4 is a view of a two-dimensional roll out representation of a portion of the outside surface, for example, a surface that comprises inside and outside diameters, of the main rotor of FIG. 3, and illustrating representative wrap angles associated with the main rotor. With reference to FIGS. 3 and 4, and as will be described further, a representative wrap angle corresponds to, or otherwise describes, a starting point on the outer diameter of a respective one of the lands (e.g., separation walls, threads) of the main rotor 14' as the point travels, during rotation of the rotor about its rotational axis, for example, rotational axis 13 in FIG. 1, from the starting point on the respective one of the lands 15, 15' of the rotor to a final point on the respective land of the rotor. It is noted that each of the lands includes a respective top surface 55, 55' the main rotor 14' further includes a plurality grooves 25, 25' that each include respective opposing groove side surfaces 57, 57', as well as a respective groove bottom surfaces 59, 59'.

Still referring to FIGS. 3 and 4, in accordance with embodiments of the present disclosure and as shown, main rotor 14' includes six (6) starting points corresponding to each respective junction between a respective one of the grooves 25, 25' and a respective one of the lands 15, 15', for example, as shown, along or at a respective on of the outside surfaces 55, 55' of the respective lands. Correspondingly, there are six (6) final points associated with the respective six starting points, positioned in similar fashion along the respective outside surfaces 55, 55' of the respective lands. An exemplary one of the six starting points is denoted by numeral 50, and each of the six (6) such starting point corresponds to a zero (0) degree reference. An exemplary one of the six final points is denoted by numeral 52, with five (5) of the six (6) such final points corresponding to a 184 degree reference.

As depicted, and in accordance with embodiments of the present disclosure, a small portion of one of the plurality of lands 15, denoted by numeral 60 in FIG. 4, is cut away, or otherwise removed, so as to form or otherwise provide a truncated land 15'. In accordance with embodiments of the present disclosure and as shown, removing portion 60 from one of the plurality of lands 15 to obtain truncated land 15' results in a wrap angle reduction of about 5 degrees, or from about 184 degrees to about 179 degrees for, or corresponding to, land 15'.

The truncated land 15' can be formed or otherwise obtained in any of a number of ways. For example, in accordance with embodiments of the present disclosure, truncated land 15' may be created by cutting away or removing for example, by a milling or similar operation, a portion, such as portion 56, of one of the lands 15. It is further contemplated that truncated land 15', in accordance with embodiments of the present disclosure, need not necessarily be formed by removing material from a land, such as land 15. Rather, land 15' may be provided directly.

In accordance with embodiments of the present disclosure, the main rotor 14' comprises a first wrap angle of greater than 180 degrees, associated with or corresponding to lands 15. In addition, in accordance with embodiments of the present disclosure, the main rotor 14' further comprises a second wrap angle of less than 180 degrees, corresponding to or comprising truncated land 15'. In accordance with embodiments of the present disclosure, the second wrap angle is distinct and different from the first wrap angle. In addition, truncated land 15' provides for an enlarged groove opening 51 in groove 25' adjacent land 15', which provides or is configured to provide additional clearance for positioning of a gaterotor as described further below.

In accordance with embodiments of the present disclosure, main rotor 14' comprises a first wrap angle corresponding to a plurality of lands, such as in the present embodiment, five lands, and a distinct and different second wrap angle, as in the present embodiment corresponding to a single land, and which is different and distinct from the first wrap angle. In accordance with embodiments of the present disclosure, a land, for example truncated land 15', is obtained such that at least one of a point, an edge, and a surface of the truncated land corresponds to a wrap angle that is less than a wrap angle that corresponds to, or is otherwise associated with, the each of the other or remaining lands of the main rotor.

As noted, it has been determined that an increase in the wrap angle of the main rotor, and particularly the wrap angles of the respective lands of the main rotor, results in an increase in compressor output. Advantageously, and in accordance with embodiments of the present disclosure, by increasing the wrap angle associated with the main rotor 14' from or about 179 degrees to at least about 184 degrees, as described herein, output of compressor 10 (see FIGS. 1 and 2) is increased by up to about 4%, for example, increased up to 3.6%. The precise increase in output, due to an increase in main rotor wrap angle as described above, depends upon the size of the overall compressor, however, it has been determined that for various compressor sizes, the increase of the wrap angle from about 179 degrees to about 184 degrees results in an increased output of between about 2 and about 4%, for example, increased up to 3.6%. In accordance with embodiments of the present disclosure, main rotor 14' can be referred to as a "high output main rotor".

In addition, for a given compressor, the internal leakage rate will remain constant. That is, advantageously, there is no resulting additional leakage due to the main rotor having an overall increased wrap angle in accordance with embodiments of the present disclosure. Still further, for a given compressor, it has been found that the amount of the rate of leakage will decrease proportionally with the increase in the capacity or output of the compressor. Thus, in accordance with embodiments of the present disclosure, overall efficiency of a given compressor is increased along with the increased wrap angle, when compared to a compressor of the same or similar size, but using a main rotor having a smaller wrap angle.

Figure 5:
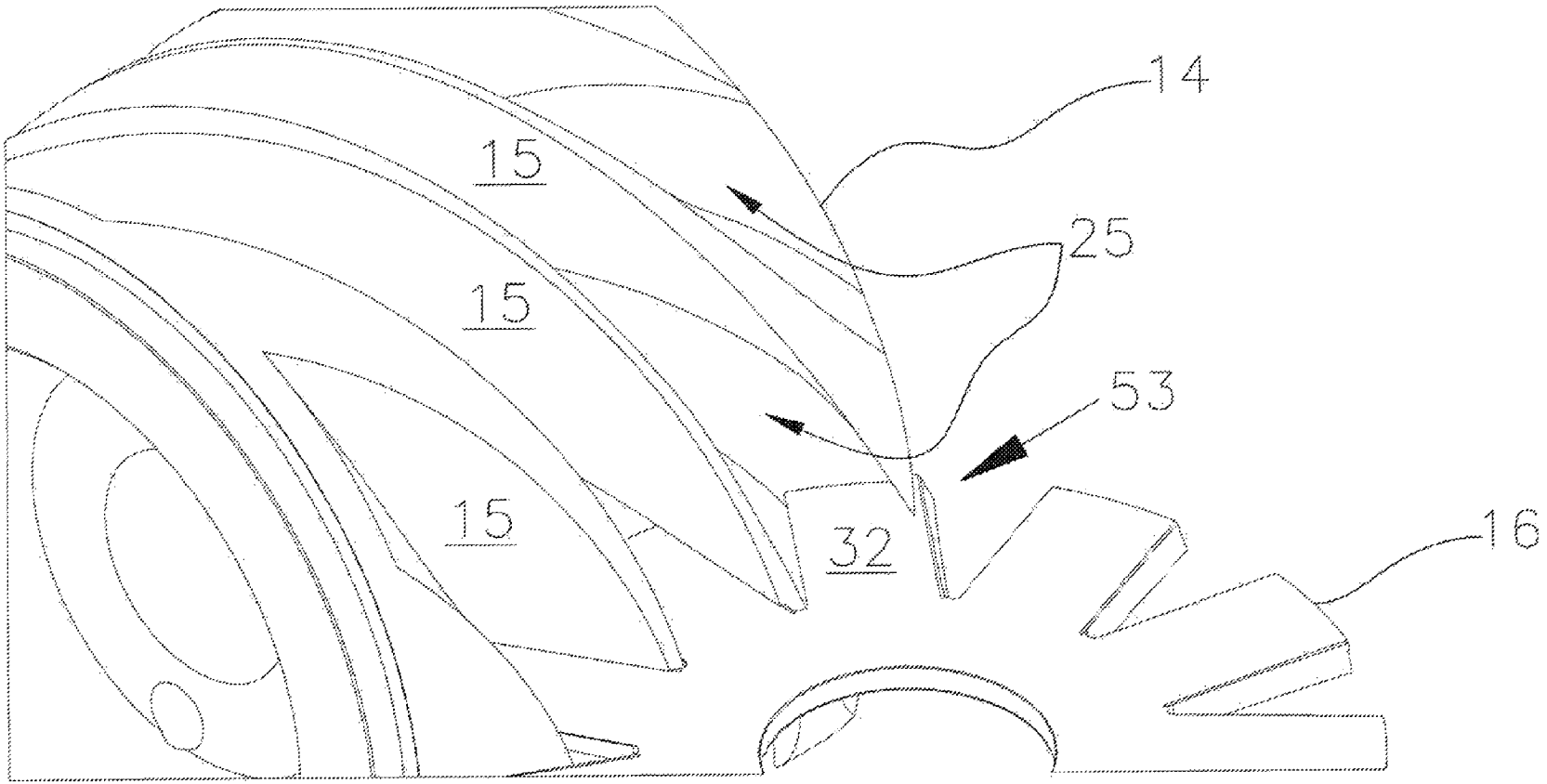
FIG. 5 is an illustrative representation of a gaterotor being placed into position with respect to a main rotor in a screw compressor, but with the gaterotor being prevented from or blocked from being so placed due to the main rotor interfering with the gaterotor.
Figure 6:
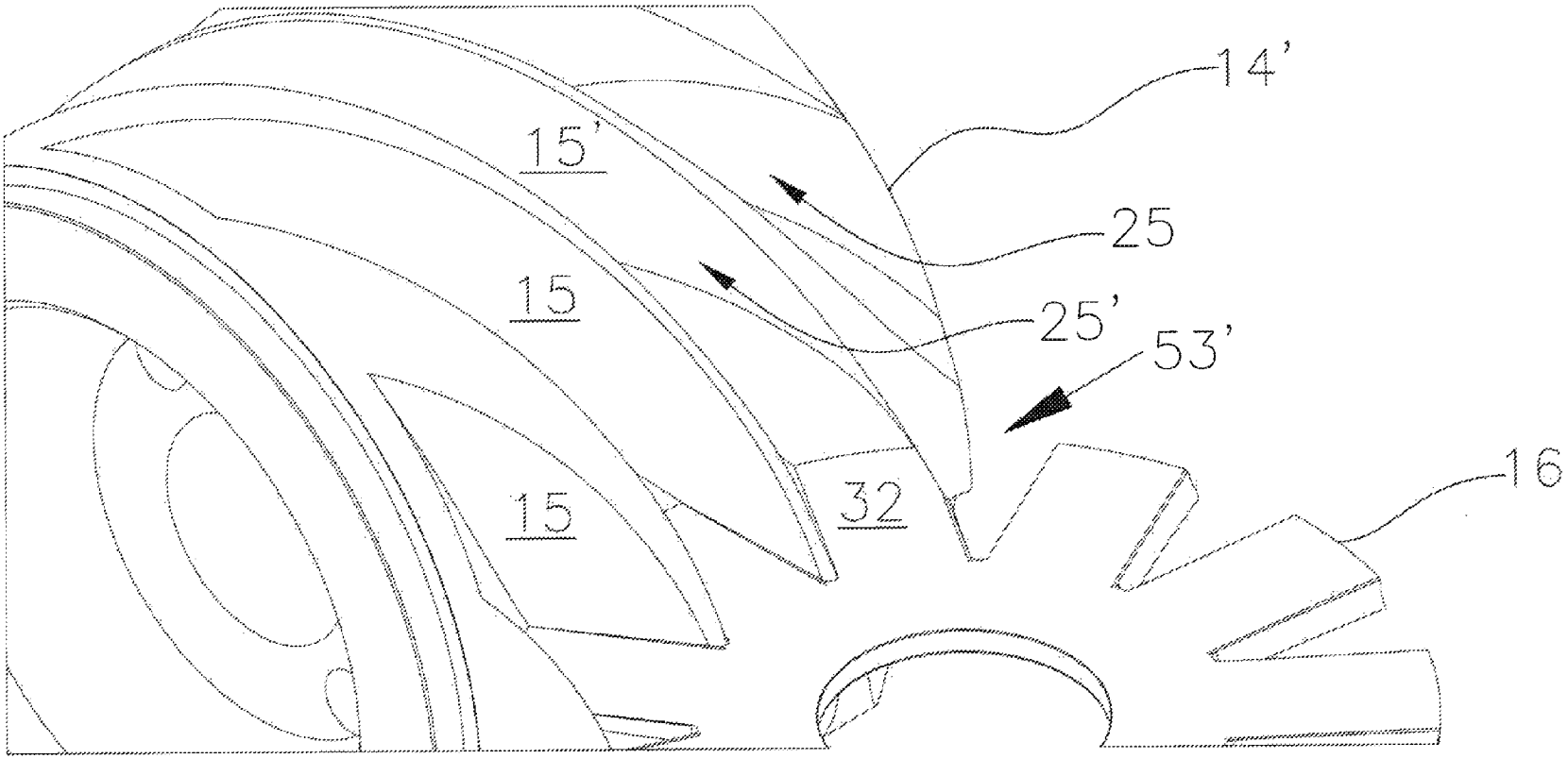
FIG. 6 is an illustrative representation, similar to FIG. 5, of the representative gaterotor of being placed into position with respect to a main rotor, such as the main rotor of FIG. 3, in accordance with exemplary embodiments of the present disclosure.

FIGS. 5-6 are illustrative representations of a representative gaterotor 16 positioning with respect to main rotors 14, 14' again, for example in a single screw compressor in accordance with exemplary embodiments of the present disclosure. More specifically, FIG. 5 schematically illustrates a main rotor 14 and having a plurality of lands 15 and grooves 25. Each of the lands 15 is identical (or substantially identical) to another of the respective lands and each of the grooves 25 is identical or substantially identical to another of the respective grooves. In the illustrated embodiments, main rotor 14 comprises a single, distinct wrap angle and the wrap angle is larger than 179 degrees, for example, a wrap angle of about 184 degrees. As shown, placement or positioning of a gaterotor 16 relative to the main rotor 14 is not possible. Stated another way, and as shown, the main rotor 14 interferes with the gaterotor 16 during relative positioning. More particularly, one of the plurality of lands 15 of the main rotor 14 (particularly and as shown the right-most land), interferes with one of the teeth 32 of the gaterotor 16 and thus prohibits placement of the gaterotor with respect to the main rotor. Such interference is indicated by arrow 53.

FIG. 6 schematically illustrates a main rotor 14' (a "high output main rotor") having a plurality of lands 15, an additional land 15', a plurality of grooves 25 and an additional groove 25', in accordance with embodiments of the present disclosure. Each of the plurality of lands 15 is identical (or substantially identical) to another of the respective lands and each of the grooves 25 is identical or substantially identical to another of the respective grooves. Main rotor 14' includes a truncated land 15' which provides for an enlarged groove opening for groove 25' adjacent thereto, provided in accordance with the above description. Accordingly, main rotor 14' comprises a plurality of different and distinct wrap angles, for example, a first wrap angle corresponding to or otherwise associated with each of the plurality of lands 15 that is larger than 179 degrees (e.g., about 184 degrees), and a second wrap angle corresponding to or otherwise associated with land 15' that is less than 180 degrees (e.g., about 179 degrees). As shown, placement or positioning of a gaterotor 16 relative to the main rotor 14', is now possible. Stated another way, and as shown, the main rotor 14' no longer interferes with the gaterotor 16 during relative positioning of the gaterotor in relation to the main rotor 14'. More particularly, truncated land 15' of the main rotor 14' provides for enlarged entry clearance or opening in groove 25', and thus positioning or placement of the teeth 32 of the gaterotor 16, is permitted. Placement of the gaterotor 16 with respect to the main rotor 14' is now possible. Such positioning is illustrated by arrow 53'. Meshing engagement of the gaterotor 16 in relation to main rotor 14' is achieved. With two gaterotors, such as gaterotors 18 of FIGS. 1 and 2, the additional or second gaterotor is positioned in a similar manner.

Figure 7:
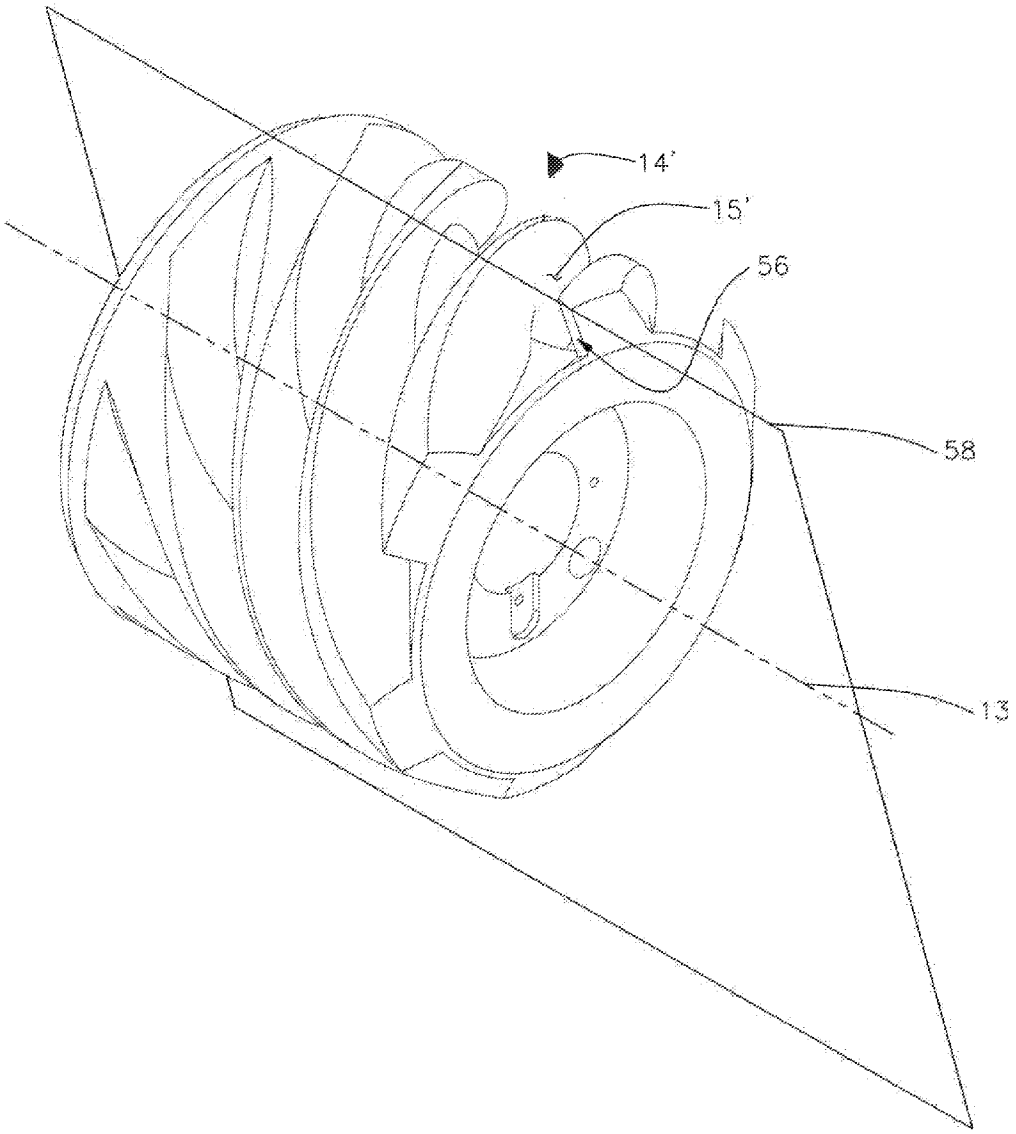
FIG. 7 is an illustration similar to FIG. 3, further illustrating, by way of example, configuration and orientation of one or more aspects of the main rotor, in accordance with at least some embodiments of the present disclosure.

As schematically illustrated in FIG. 7, in accordance with at least some embodiments, a surface 56, provided in the land 15' of the main rotor 14', such as by removal of a portion of the respective land as described above, includes or corresponds to a plane 58 that passes through the axis of rotation 13 of the main rotor. However, this is not required. For example, in at least some embodiments, the surface can be offset from the axis of rotation. In at least some embodiments, the surface 56 can be flat, or substantially flat, but modification to this shape or contour, including modification to the perimeter (including one or more edges of the perimeter) can vary and such variation is contemplated and considered within the scope of the present disclosure.

The precise amount or size of the removed portion, or more generally the shape of the surface, such as surface 56, provided for in the high output land, such as land 15', corresponds to, or can be configured to correspond to, the wrap angle that is desired. In accordance with at least some embodiments, the main rotor comprises a land that is distinct or different from the remaining lands. In at least some embodiments, the land is a truncated land having a flat or substantially flat edge or surface which permits a gate rotor designed for assembly and use with the main rotor to be assembled or otherwise positioned with respect to the main rotor. In at least some embodiments, such assembly is provided by increasing a gaterotor clearance associated with one of the grooves, particularly the groove positioned adjacent to the truncated or high output land having a reduced wrap angle.

The invention is not limited to the embodiments disclosed herein. For example, the term "wrap angle" is defined in a representative fashion and in conjunction with a representative main rotor. Further, it is appreciated that the main rotor may vary and is not limited to having threads (including grooves) of the particular geometry or shape shown and described. Similarly, it will be appreciated that the precise shape or portion of the removed portion of the main rotor can vary (and the resultant profile of the main rotor including the profile of the portion having reduced wrap angle as shown and described can vary), provided that there a reduction in wrap angle is achieved.

In accordance with at least some embodiments of the present disclosure, a single screw gas compressor is disclosed that comprises: a housing including a cylindrical bore; a pair of gate rotors mounted for rotation in the housing, each gate rotor having a plurality of gear teeth; and a main rotor rotatably mounted in the bore and having a plurality of grooves, a plurality of lands, an additional groove, and an additional land; wherein the plurality of lands of the main rotor comprises a first wrap angle and the additional land comprises a second wrap angle, and the second wrap angle is distinct and different from the first wrap angle. In at least some embodiments, the first wrap angle is greater than 180 degrees and the second wrap angle is less than 180 degrees. Further, in at least some embodiments, the first wrap angle is about 184 degrees and the second wrap angle is about 179 degrees. Further, in at least some embodiments, the additional land includes a surface that corresponds to a plane that passes through an axis of rotation of the main rotor. Further, in at least some embodiments, the additional groove is positioned adjacent the additional land and is configured to receive, by way of an enlarged opening, a respective one of the plurality of teeth of the gaterotor. Still further, in at least some embodiments, the first wrap angle is greater than 180 degrees and the second wrap angle is less than 180 degrees and, in at least some embodiments, the first wrap angle is about 184 degrees and the second wrap angle is about 179 degrees. Further, in at least some embodiments, the plurality of grooves comprises five grooves, the plurality of lands comprises five lands and, additionally, in at least some embodiments, each gate rotor includes eleven teeth. Further, in at least some embodiments, the additional land is a truncated land. And, in at least some embodiments, the additional land is a high output land.

Moreover, in accordance with at least some embodiments of the present disclosure, disclosed herein is a method of assembling a gate rotor in relation to a main rotor that is positioned within a housing of a single screw gas compressor configured for high output, the gate rotor having a plurality of gear teeth, the main rotor having a plurality of grooves, a plurality of lands, an additional groove, and an additional land. The method comprises, in at least some embodiments, positioning the gaterotor such that at least one of the plurality of gear teeth is configured to be received within the additional groove, the additional groove being positioned adjacent the additional land; wherein the plurality of lands of the main rotor comprises a first wrap angle and the additional land comprises a second wrap angle, and the second wrap angle is distinct and different from the first wrap angle. In accordance with at least some embodiments, the first wrap angle is greater than 180 degrees and the second wrap angle is less than 180 degrees and further, in at least some embodiments, the first wrap angle is about 184 degrees and the second wrap angle is about 179 degrees. In at least some embodiments, the method comprises receiving, in the additional groove, a respective one of the plurality of teeth of the gaterotor and, further, in at least some embodiments, the receiving is accomplished by way of an enlarged opening that is at least one of adjacent to and formed at least partially along with the additional groove.

In accordance with at least some embodiments of the present disclosure, a main rotor device for use with a single screw compressor configured for high output is disclosed and which comprises a main rotor body having formed therein a plurality of grooves, a plurality of lands, an additional groove, and an additional land; wherein the plurality of lands of the main rotor comprises a first wrap angle and the additional land comprises a second wrap angle, and the second wrap angle is distinct and different from the first wrap angle. In at least some embodiments, the plurality of grooves and the additional groove is operable to meshingly engage with a plurality of gear teeth of a gate rotor. Further, in at least some embodiments, the main rotor is a high output main rotor. Still further, in at least some embodiments, the first wrap angle is greater than 180 degrees and the second wrap angle is less than 180 degrees. Further still, in at least some embodiments, the plurality of grooves and the additional groove are operable to meshingly engage with a plurality of gear teeth of a gate rotor. Moreover, in at least some embodiments, the first wrap angle is about 184 degrees and the second wrap angle is about 179 degrees. Further, in at least some embodiments, meshing engagement of the additional groove and a respective one of the plurality of teeth of the gaterotor is by way of an enlarged opening. Still further, in at least some embodiments, the plurality of grooves comprises five grooves, the plurality of lands comprises five lands. And, in at least some embodiments, the additional land includes a surface, or at least a portion of a surface, that corresponds to a plane that passes through an axis of rotation of the main rotor.

It is specifically intended that the present invention not be limited to the embodiments and illustrations contained herein, but include modified forms of those embodiments including portions of the embodiments and combinations of elements of different embodiments as come within the scope of the following claims.

The invention claimed is:

1. A method of assembling a gate rotor in relation to a main rotor that is positioned with in a housing of a single screw gas compressor configured for high output, the gate rotor having a plurality of gear teeth, the main rotor having a plurality of grooves, a plurality of lands, and additional groove, and an additional land, and the method comprising:

mounting the gate rotor such that at least one of the plurality of gear teeth is configured to be received within the additional groove, the additional groove being positioned adjacent the additional land;

Wherein the plurality of lands of the main rotor includes a first wrap angle that is greater than 180 degrees and the additional land includes a second wrap angle that is distinct and different from the first wrap angle and that is less than 180 degree, such that the main rotor is structured to include an enlarged entry opening to permit the positing of the gate rotor.

2. The method of claim 1, wherein the enlarged opening is at least one of adjacent to and formed at least partially along with the additional groove.

3. A main rotor device for use with a single screw compressor configured for high output, the main rotor comprising:

a main rotor body having formed therein a plurality of grooves, a plurality of lands, an additional groove, and an additional land;

wherein the plurality of lands of the main rotor includes a first wrap angle that is greater than 180 degrees and the additional land includes a second wrap angle that is distinct and different from the first wrap angle and that is less than 180 degrees, such that the main rotor is structured to include an enlarged entry opening to permit positioning of a gate rotor in relation to the main rotor.

4. The main rotor device of claim 3, wherein the plurality of grooves and the additional groove is operable to meshingly engage with a plurality of gear teeth of the gate rotor and wherein the main rotor is a high output main rotor.

5. The main rotor device of claim 3, wherein the enlarged opening is at least one of adjacent to and formed at least partially along with the additional groove.

6. The main rotor device of claim 3, wherein additional land includes a surface that corresponds to a plane that passes through an axis of rotation of the main rotor.

7. A single screw gas compressor comprising:

a housing including a cylindrical bore;

a pair of gate rotors mounted for rotation in the housing, each gate rotor having a plurality of gear teeth; and a main rotor rotatably mounted in the bore and having a plurality of grooves, a plurality of lands, an additional groove, and an additional land;

wherein the plurality of lands of the main rotor includes a first wrap angle that is greater than 180 degrees and the additional land includes a second wrap angle that is distinct and different from the first wrap angle and that is less than 180 degrees, such that the main rotor is structured to include an enlarged entry opening to permit positioning of the pair of gate rotors in relation to the main rotor.

8. The compressor of claim 7, wherein the enlarged opening is at least one of adjacent to and formed at least partially along with additional groove.

9. The compressor of claim 8, wherein the first wrap angle is about 184 degrees and the second wrap angle is about 179 degrees.

10. The compressor of claim 7, wherein the plurality of grooves comprises five grooves, the plurality of lands comprises five lands.

11. The compressor of claim 10, wherein each gate rotor includes eleven teeth.

12. The compressor of claim 7, wherein the additional land is a truncated land.

13. The compressor of claim 7, wherein the additional land is a high output land.

14. The main rotor device of claim 3, wherein the plurality of grooves and the additional groove are operable to meshingly engage with a plurality of gear teeth of a gate rotor.

* * * * *

UNITED STATES PATENT AND TRADEMARK OFFICE

CERTIFICATE OF CORRECTION

PATENT NO. : 9,057,373 B2
APPLICATION NO. : 13/673533
DATED : June 16, 2015
INVENTOR(S) : Jean-Louis Picouet It is certified that error appears in the above-identified patent and that said Letters Patent is hereby corrected as shown below:

In the Claims, Claim 1

Column 8, line 59, replace "with in" with --within--

Signed and Sealed this
Thirteenth Day of October, 2015

Michelle K. Lee

Michelle K. Lee
*Director of the United States Patent and Trademark Office*